US005406781A

United States Patent [19]

Yokoya

[11] Patent Number: 5,406,781

[45] Date of Patent: Apr. 18, 1995

[54] UNTWISTING NOZZLE FOR A SPLICER

[75] Inventor: Atsuto Yokoya, Nagaokakyo, Japan

[73] Assignee: Murata Kikai Kabushiki Kaisha, Kyoto, Japan

[21] Appl. No.: 72,711

[22] Filed: Jun. 7, 1993

[30] Foreign Application Priority Data

Jun. 10, 1992 [JP] Japan ..... 4-176062

[51] Int. Cl.[6] ..... D01H 15/00

[52] U.S. Cl. ..... 57/1 UN; 57/22

[58] Field of Search ..... 57/22, 1 UN, 2.3

[56] References Cited

U.S. PATENT DOCUMENTS

| | | | |
|---|---|---|---|
| Re. 27,717 | 8/1973 | Breen et al. | 57/289 X |
| 4,494,366 | 1/1985 | Dano | 57/22 |
| 4,555,899 | 12/1985 | Mima | 57/22 |
| 4,607,482 | 8/1986 | Otoshima | 57/22 |
| 4,608,815 | 9/1986 | Rohner et al. | 57/22 |
| 4,769,981 | 9/1988 | Artzt et al. | 57/22 X |
| 4,833,872 | 5/1989 | Czelusniak et al. | 57/22 |
| 4,852,339 | 8/1989 | Premi | 57/22 |
| 5,175,983 | 1/1993 | Artzt et al. | 57/22 X |

FOREIGN PATENT DOCUMENTS

| | | | |
|---|---|---|---|
| 3518316 | 11/1986 | Germany | 57/22 |

*Primary Examiner*—Joseph J. Hail, III

*Attorney, Agent, or Firm*—Spensley Horn Jubas & Lubitz

[57] ABSTRACT

An untwisting nozzle is provided with a cylindrical untwisting space for receiving whirling air currents, having a relatively small diameter, a cylindrical yarn sucking space for receiving suction air currents, having a relatively large diameter and formed in parallel to the untwisting space, and a slit interconnecting the untwisting space and the yarn sucking space.

5 Claims, 6 Drawing Sheets

UNTWISTING NOZZLE FOR A SPLICER

BACKGROUND OF THE INVENTION

1. Field of the Invention

The present invention relates to an untwisting nozzle for a splicer for splicing yarn ends, installed in combination with a spinning frame or a winder.

2. Prior Art

A splicer employing a compressed fluid for splicing yarn ends has been disclosed in Japanese Patent Laid-open (Kokai) No. 64-26742. When a slub catcher detects yarn breakage or a defect in the yarn while the yarn is being taken up on a spinning frame or a winder, this known splicer pulls the upper free end and lower free end of the yarn, clamps the upper free end and lower free end of the yarn, untwists the upper and lower free ends by applying a compressed air in a state suitable for splicing with separate untwisting nozzles, respectively, overlaps the untwisted upper and lower free ends in a splicing nozzle, and splices the upper and lower free ends by the agency of a compressed fluid.

An untwisting nozzle employed in this known splicer for untwisting a hard twist yarn (strongly twisted yarn) is provided with an untwisting space formed in a relatively small diameter to enhance the untwisting action of the compressed fluid. Accordingly, it is difficult to introduce the upper and lower free ends of a yarn into the untwisting space.

SUMMARY OF THE INVENTION

It is an object of the present invention to provide an untwisting nozzle for a splicer, facilitating introducing the free ends of a yarn into the untwisting space thereof and capable of satisfactorily untwisting a hard twist yarn.

To achieve the object, the present invention provides an untwisting nozzle for a splicer, provided with an untwisting space, at least one air jet hole for jetting compressed fluid into the untwisting space, a yarn introducing space formed in parallel to the untwisting space, an air jet hole for jetting compressed fluid into the yarn introducing space, and a slit interconnecting the untwisting space and the yarn introducing space. The untwisting space and the yarn introducing space may be cylindrical and the diameter of the former may be smaller than that of the latter. The plurality of jet holes of the untwisting nozzle may be arranged on different levels, respectively, and the inclinations of the lower air jet holes may be smaller than those of the upper air jet holes.

The untwisting nozzle for a splicer sucks the free end of a yarn into the yarn introducing space by the agency of the suction currents flowing through the yarn introducing space, makes the free end enter the untwisting space through the slit, and untwists the free end in a state suitable for splicing by the agency of the swirling air currents. When the diameter of the untwisting space is smaller than that of the yarn introducing space, the respective function of the untwisting space and the yarn introducing space are further enhanced. When the plurality of air jet holes of the untwisting nozzle are arranged on different levels, respectively, the suction of the untwisting space is enhanced. When the inclinations of the upper air jet holes are smaller than those of the lower air jet holes, the suction of the untwisting space is further enhanced, whereby the free end is sucked deep into the untwisting space and untwisted satisfactorily.

DETAILED DESCRIPTION OF PREFERRED EMBODIMENT

Figure 1:
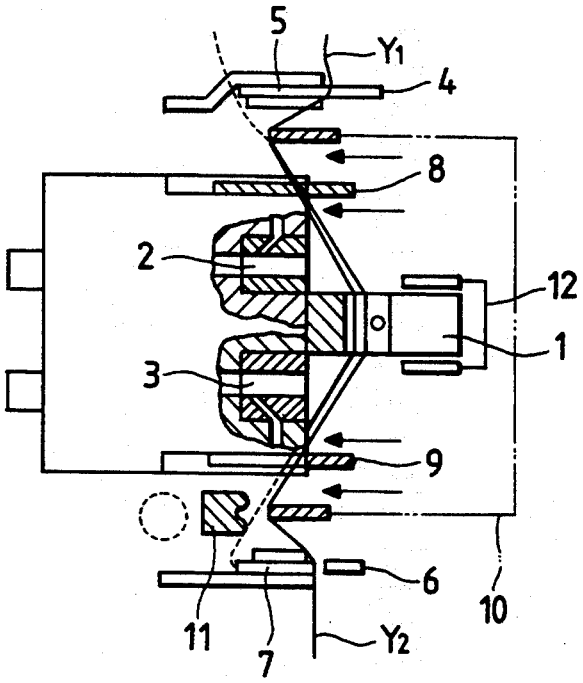
FIG. 1 is a view of assistance in explaining the operation of a splicer for introducing yarns and cutting the free ends of the yarns.
Figure 2:
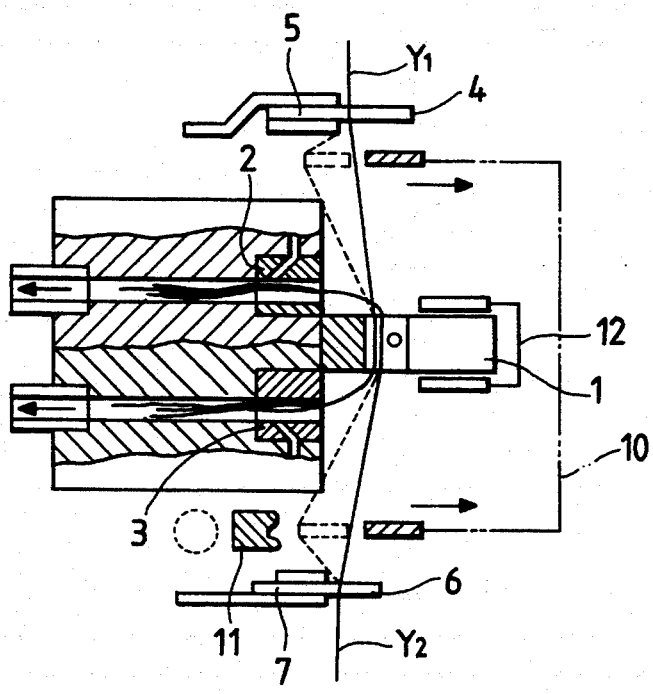
FIG. 2 is a view of assistance in explaining the untwisting operation of the splicer.
Figure 3:
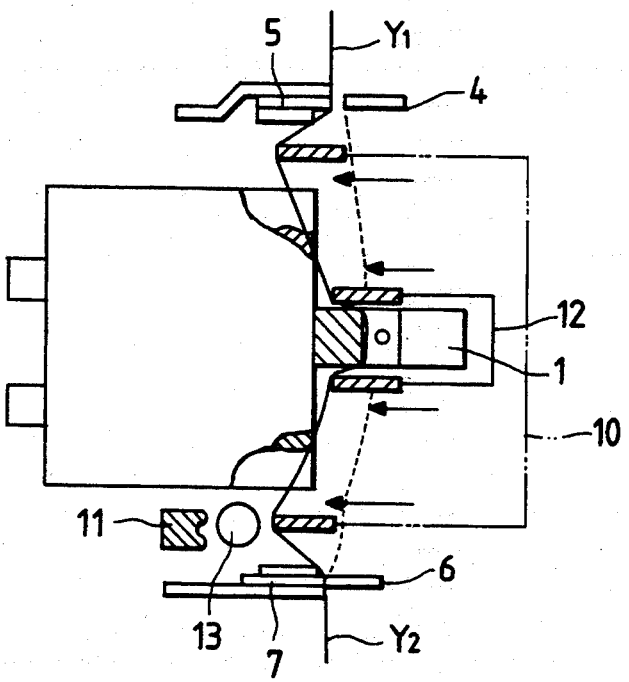
FIG. 3 is a view of assistance in explaining the splicing operation of the splicer.
Figure 4:
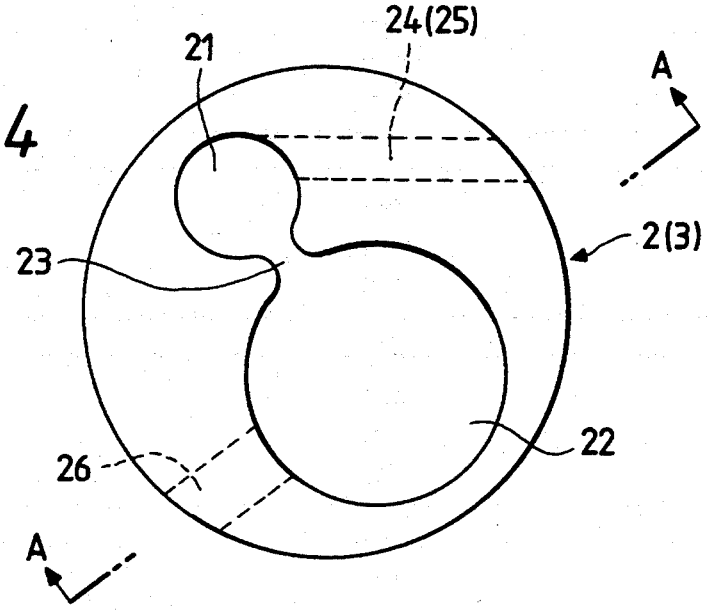
FIG. 4 is a plan view of an untwisting nozzle.
Figure 5:
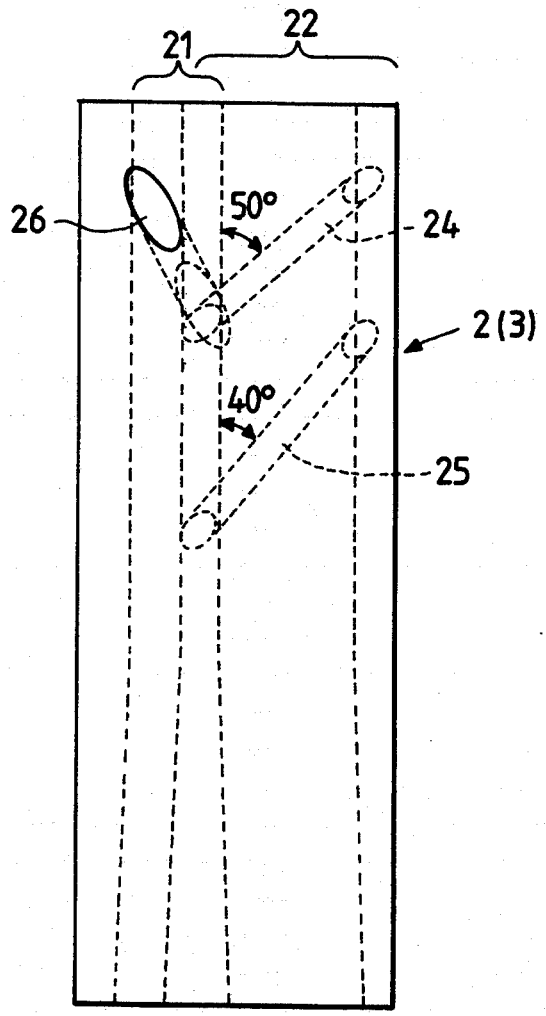
FIG. 5 is a side view of an untwisting nozzle.
Figure 6:
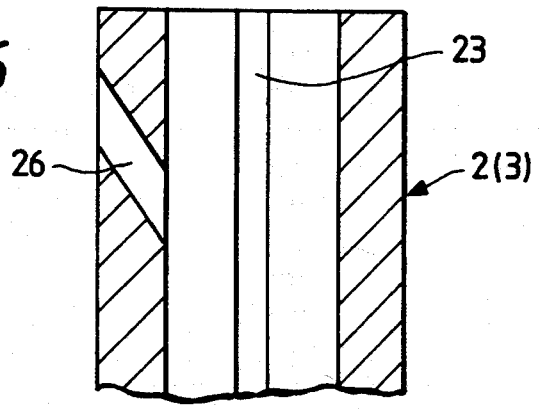
FIG. 6 is a sectional view taken on line A—A in FIG. 4.

The general construction of a splicer will be explained through the explanation of a yarn splicing operation with reference to FIGS. 1 to 3 showing an upper untwisting nozzle and a lower untwisting nozzle in sectional views.

A yarn drawing lever 10 turns to introduce an upper yarn $Y_1$ and a lower yarn $Y_2$ into a yarn splicing nozzle 1. Then, a swing lever 4 operates to clamp the upper yarn $Y_1$ between clamping plate 5 and the swing lever 4 and, similarly, the lower yarn $Y_2$ is clamped between a clamp guide 6 and a clamping plate 7 as shown in FIG. 1. Then, the free end of the lower yarn $Y_2$ projecting from the clamping position is cut at a predetermined distance from the clamping position with a yarn cutter 8 and, similarly, the free end of the upper yarn $Y_1$ is cut with a yarn cutter 9 as shown in FIG. 1. In this state, a yarn holding lever 12 is held at a inoperative position.

Subsequently, compressed air is blown through the untwisting nozzles 2 and 3, and, at the same time, the yarn drawing lever 10 is turned in the direction of the arrow (FIG. 2) to suck the free end of the lower and $Y_2$ into the untwisting nozzle 2 and to suck the free end of the upper yarn $Y_1$ into the untwisting nozzle 3, and the free ends of the upper yarn $Y_1$ and the lower yarn $Y_2$ are untwisted as shown in FIG. 2 in a state suitable for splicing.

As shown in FIG. 3, the yarn drawing lever 10 is operated again before or after the completion of untwisting the free ends of the yarns as far as one end thereof comes into contact with a stopper 13 provided in addition to another stopper 11 to pull out the untwisted free ends from the untwisting nozzles 2 and 3. Then, the yarn holding lever 12 turns guiding the free ends of the yarns and holds the free ends of the yarns in place and, at the same time, compressed air is jetted from the yarn splicing nozzle 1 to splice the free ends of the yarn by making the free ends of the yarns twist around each other.

Upon the completion of the splicing operation, the yarn drawing lever 10 and the yarn holding lever 12 are separated from the upper yarn $Y_1$ and the lower yarn $Y_2$, the continuous yarn is released from the splicing nozzle 1, and then a normal yarn winding operation is resumed.

The untwisting nozzle 2 (3) is provided with a cylindance with the present invention will be described hereinafter with reference to FIGS. 4 to 7.

The untwisting nozzle 2 (3) is provided with a cylindrical untwisting space 21, a cylindrical yarn introducing space 22 formed in parallel to the untwisting space 21, and a slit 23 interconnecting the untwisting space 21 and the yarn introducing space 22.

The untwisting space 21 has a diameter small enough to untwist a hard twist yarn and smaller than that of the untwisting space of a standard untwisting nozzle. The untwisting nozzle 2 (3) is provided with two air jet holes 24 and 25 tangent to the circumference of the untwisting space 21. It is preferable to arrange the two air jet holes 24 and 25 on different levels, respectively, to such the free end of a yarn deep into the untwisting space 21 for satisfactory untwisting. When the inclination of the lower air jet hole 25 with respect to the untwisting space 21 is smaller than that of the upper air jet nozzle 24 with respect to the untwisting space 21, the free end of the yarn can be more effectively sucked into the untwisting space. Incidentally, in this embodiment, the inclination of the upper air jet hole 24 is 50° and the inclination of the lower air jet hole 25 is 40°.

Figure 7:
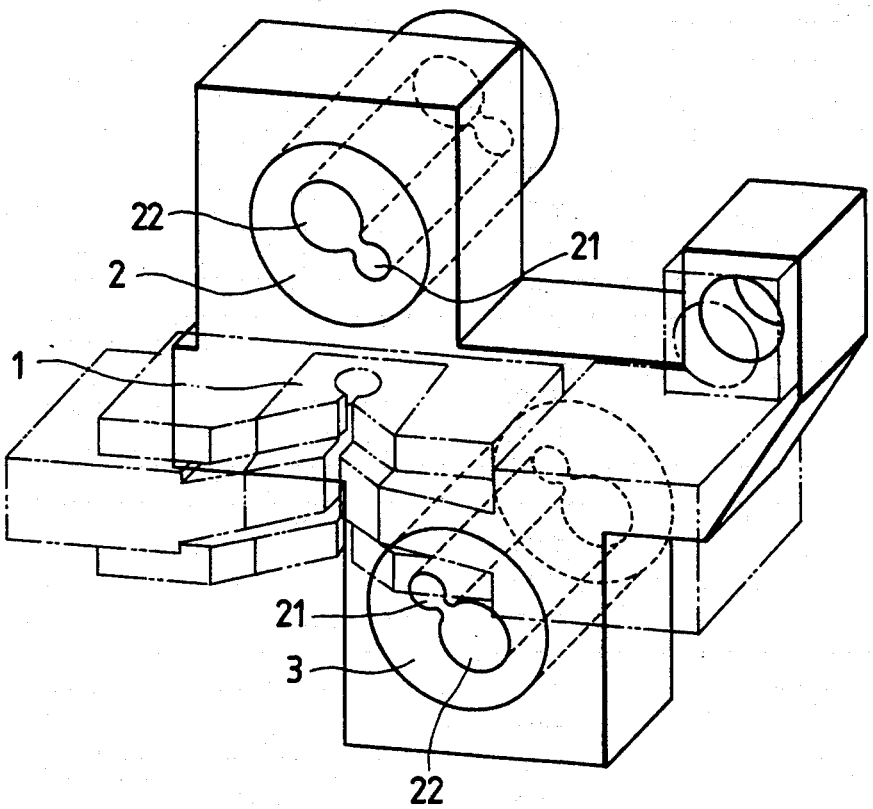
FIG. 7 is a perspective view showing the positions of untwisting nozzles relative to a splicing nozzle.

The diameter of the yarn introducing space 22 is large enough to suck in the free end of a yarn easily. The diameter of the yarn introducing space 22 is greater than that of the untwisting space 21. The untwisting nozzle 2 (3) is provided with an air jet hole 26 opening into the yarn introducing space 22. As shown in FIG. 7, the yarn introducing space 22 is remote from the splicing nozzle 1 relative to the untwisting space 21. That is, the yarn introducing space 22 of the untwisting nozzle 2 is formed above the untwisting space 21, and the yarn introducing space 22 of the untwisting nozzle 3 is formed below the untwisting space 21.

When compressed air is jetted through the air jet hole 26 into the yarn introducing space 22 of the untwisting nozzle 2 (3), the free end of the yarn is sucked into the yarn introducing space 22 by suction produced in the yarn introducing space 22, is biased naturally toward the splicing nozzle 1, and moves through the slit 23 into the untwisting space 21. Then, compressed air is blown through the air jet holes 24 and 25 to untwist the free end of the yarn 6o that it is in a state suitable for splicing by the strong untwisting action of the compressed air.

The untwisting nozzle of the present invention thus formed has the following advantages.

The untwisting nozzle is capable of smoothly sucking a thick yarn into the yarn sucking space and of satisfactorily untwisting a hard twist yarn. When the plurality of air jet holes are arranged on different levels, respectively, and the inclination of the lower air jet hole is smaller than that of the upper air jet hole, the free end of a yarn can be sucked deep into the untwisting space for satisfactory untwisting. Such a satisfactory performance of the untwisting nozzle reduces the frequency of unsuccessful yarn splicing operation and enables the splicer to splice yarns firmly.

When splicing free ends of yarns by the splicer provided with the untwisting nozzles for hard twist yarns, the state of untwisted free ends varies depending on circumstances because the free ends are not held firmly during the untwisting operation of the untwisting nozzles and, sometimes, an imperfect joint having in sufficient strength is formed.

Accordingly, this embodiment of the present invention provides a splicer provided with untwisting nozzles capable of uniformly untwisting the free ends of yarns and of always providing untwisted free ends of a desired quality.

A splicer of this embodiment is provided with untwisting nozzles, and gripping members capable of being moved near to the inlets of the untwisting nozzles, respectively, to prevent the propagation of twists by gripping the free ends of yarns.

When splicing the free ends of yarns by the splicer, the free ends of the yarns are held between the untwisting nozzles and the gripping members when the free ends are sucked into the untwisting nozzles, respectively, so that the free ends are untwisted effectively.

The general construction of a splicer in a preferred embodiment according to the present device will be understood from the following description of the splicing operation thereof taken in connection with FIGS. 1 to 3 and 9, in which upper and lower untwisting nozzles are shown in sectional views and in a diagram.

A yarn drawing lever 10 turns to introduce an upper yarn $Y_1$ and a lower yarn $Y_2$ into a yarn splicing nozzle 1. Then, a swing lever 4 operates to clamp the upper yarn $Y_1$ between clamping plates 5 and, similarly, the lower yarn $Y_2$ is clamped between a clamp guide 6 and a clamping plate 7 as shown in FIG. 1. Then, the free end of the lower yarn $Y_2$ projecting from the clamping position is cut at a position at a predetermined distance from the clamping position with a yarn cutter 8 and, similarly, the free end of the upper yarn $Y_1$ is cut with a yarn cutter 9 as shown in FIG. 1. In this state, a yarn holding lever 12 is held at an inoperative position.

Subsequently, compressed air is blown through untwisting nozzles 2 and 3, and, at the same time, the yarn drawing lever 10 is turned in the direction of the arrow (FIG. 2) to suck the free end of the lower yarn $Y_2$ into the untwisting nozzle 2 and to suck the free end of the upper yarn $Y_1$ into the untwisting nozzle 3, and the free ends of the upper yarn $Y_1$ and the lower yarn $Y_2$ are untwisted as shown in FIG. 2 so that they are in a state suitable for splicing. In this splicer, upon the suction of the free ends of the upper yarn $Y_1$ and the lower yarn $Y_2$ into the untwisting nozzles 3 and 2, respectively, the yarn holding lever 12 advances and comes into contact with the untwisting nozzles 2 and 3 to hold the upper yarn $Y_1$ and the lower yarn $Y_2$ between the yarn holding lever 12, and the untwisting nozzles 2 and 3, so that the free ends are untwisted properly.

Figure 9:
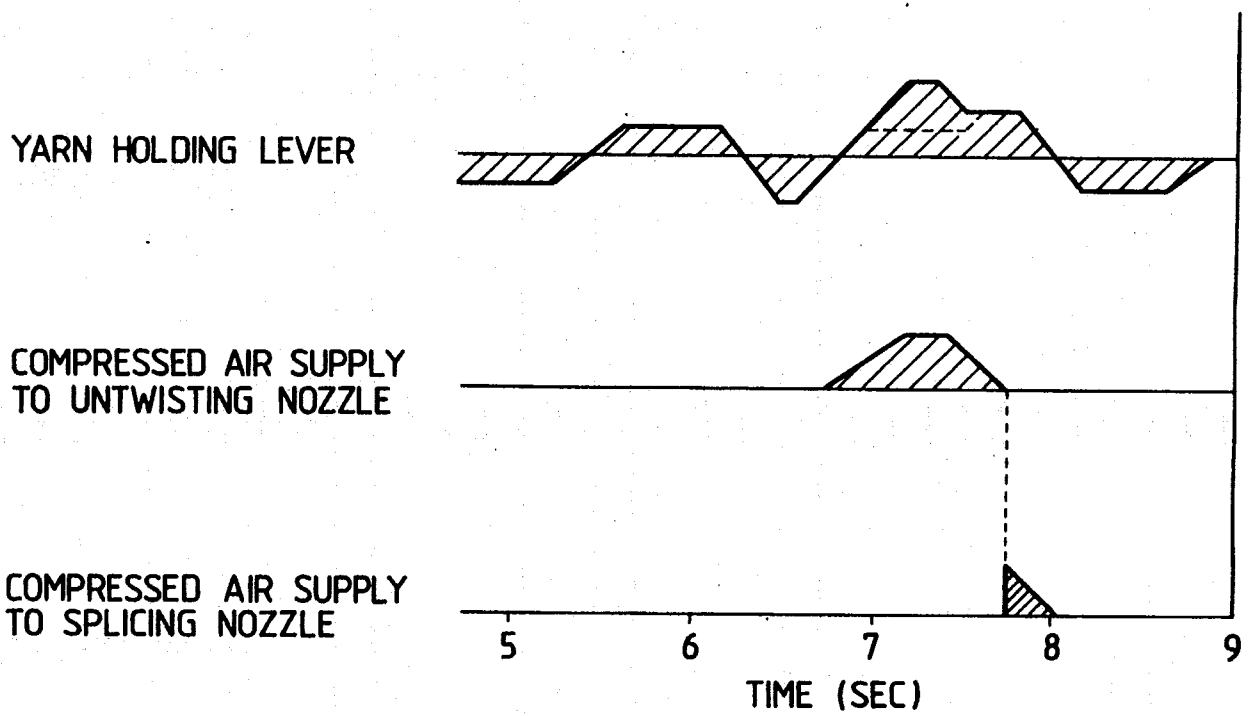
FIG. 9 is a diagram of assistance in explaining the operation of the yarn holding lever, an operation for jetting air into the untwisting nozzle and an operation for jetting air into the splicing nozzle.

The yarn holding lever 12 is retracted to a yarn gripping position for splicing shown in FIG. 3 before or after the completion of untwisting the free ends of the yarns. Then, the yarn drawing lever 10 is operated again so as to turn as far as a position where the yarn drawing lever 10 is stopped by a stopper 13 provided in addition to another stopper 11, guiding the free ends of the yarns to pull out the untwisted free ends from the untwisting nozzles 2 and 3. In this state, the free ends of the upper yarn $Y_1$ and the lower yarn $Y_2$ are held between the yarn holding lever 12 and the side surface of the yarn splicing nozzle 1. Then, compressed air is jetted from the yarn splicing nozzle 1 to splice the free ends of the yarns by making the free ends of the yarns twist around each other. In a diagram of FIG. 9 showing the motion of the yarn holding lever 12, the dotted line indicates the motion of the yarn holding lever of a prior art splicer.

Upon the completion of the splicing operation, the yarn drawing lever 10 and the yarn holding lever 12 are separated from the upper yarn $Y_1$ and the lower yarn $Y_2$, the continuous yarn is released from the splicing nozzle 1, and then a normal yarn winding operation is resumed.

Figure 8:
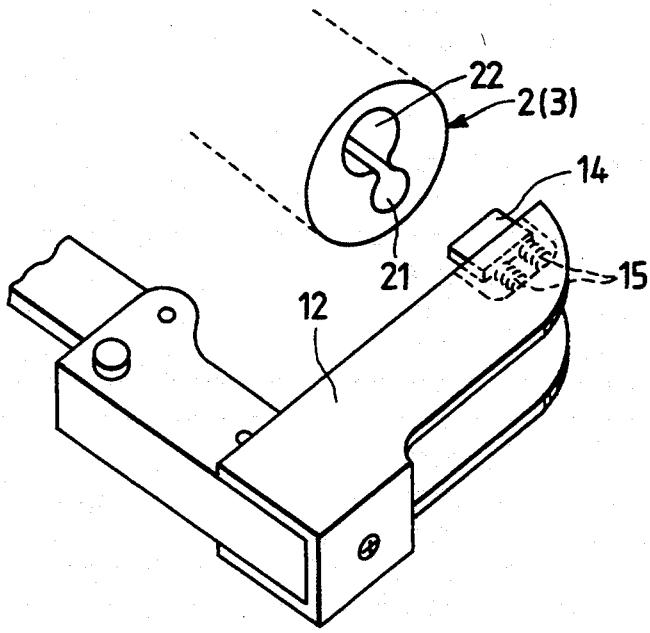
FIG. 8 is a perspective view of a yarn holding lever.

The yarn holding lever 12 will be described with reference to FIG. 8.

Basically, the yarn holding lever 12 is the same in shape as the prior art yarn holding lever. The yarn holding lever 12 of the present invention is provided with gripping members 14 to prevent the propagation of twists by gripping the yarns between the gripping members 14 and the untwisting nozzles 2 and 3, respectively. Each gripping member 14 is formed of a melamine resin or the like, supported on the operative end of the yarn holding lever 12, and biased with springs 15 so that a portion thereof will protrude from the operative end. When the yarn holding lever 12 is advanced and brought into engagement with the untwisting nozzles 2 and 3, the gripping members 14 are pressed resiliently against the untwisting nozzles 2 and 3 to hold the yarns firmly on the untwisting nozzles 2 and 3, respectively. The untwisting nozzles 2 and 3 may be provided with elastic pads at positions corresponding to the gripping members 14, respectively.

The splicer of the present invention need not necessarily be provided with the untwisting nozzles 2 and 3 described herein and may be provided with untwisting nozzles other than the untwisting nozzles 2 and 3. The splicer can also be effectively applied to splicing yarns other than hard twist yarns.

As is apparent from the foregoing description, this embodiment of the present invention has the following advantages.

The untwisting nozzles are able to untwist the free ends of yarns always in an invariable state and hence the splicer is able to form a joint having a high strength and appearance which cannot be discriminated from other portions of the yarns.

The inner surface of the untwisting space 21 may be formed to be rugged or uneven. For example, circular ruggedness or spiral ruggedness such as a screw is preferably formed and screwed face is best in processing. The untwisting nozzle in which the inner surface of the untwisting space 21 is formed to be rugged can make the free end of a yarn to be more flapped than that in which the inner surface of the untwisting space 21 is smooth, so that the untwisting effect may be further enhanced.

In the untwisting nozzle 2 (3), constructed as mentioned above, when the compressed air is jetted through the air jet hole 26 into the yarn introducing space 22, the free end of the yarn is sucked into the yarn introducing space 22 by suction produced in the yarn introducing space 22, is biased naturally toward the splicing nozzle 1, and moves through the slit 23 into the untwisting space 21. Then, compressed air is jetted through the air jet holes 24 and 25, turning and pulsatile flow produced by the rugged inner surface of the untwisting space is strongly applied to the free yarn end, and the free yarn end is flapped and untwisted in a state suitable for splicing. Since the diameter of the untwisting space 21 for untwisting the free yarn end is small, the untwisting nozzle of this embodiment can strongly apply an air current for untwisting to the free yarn end and the sufficient untwisting effect is obtained. Furthermore, the free yarn end is more flapped in the untwisting space 21 because the inner face of the untwisting space 21 is formed to be rugged. So, even if the yarn is a hard twisted yarn or a two ply yarn, the free end thereof can be sufficiently untwisted. It is difficult to directly introduce the free yarn end into the untwisting space 21 of which diameter is small and inner surface is rugged. However, according to the present invention, the free end of the yarn may be sucked smoothly since the yarn introducing space 22 having larger diameter than that of the untwisting space 21 is provided and the free yarn end is introduced into the untwisting space 21 from the introducing space 22 through the slit 23.

Figure 10:
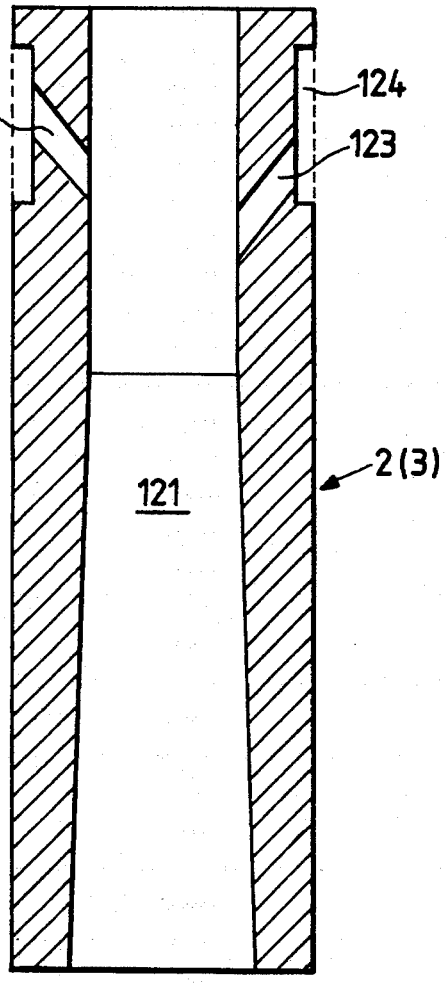
FIG. 10 is a longitudinal sectional view of an untwisting nozzle in a preferred embodiment according to the present invention.
Figure 11:
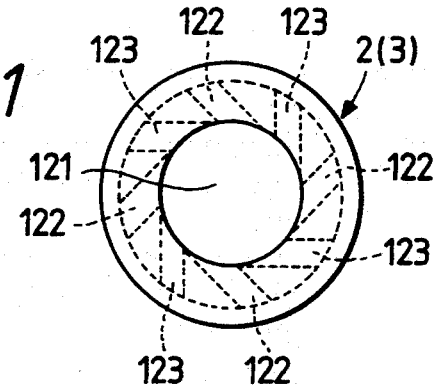
FIG. 11 is a plan view of the untwisting nozzle of FIG. 10.

An untwisting nozzle in another embodiment according to the present invention will be described hereinafter with reference to FIGS. 10 and 11.

The another embodiment of the present invention provides an untwisting nozzle for a splicer, provided with a yarn introducing/untwisting space having a relatively large diameter facilitating the suction of the free end of a yarn and capable of satisfactorily untwisting a hard twist yarn.

An untwisting nozzle for a splicer of the embodiment is provided with a cylindrical untwisting space, and a plurality of air jet holes arranged on different levels so as to jet swirling air currents into the untwisting space.

In the untwisting nozzle of such a conformation, compressed air is jetted through the air jet holes into the untwisting space to generate swirling air currents within the yarn introducing untwisting space. Then, the free end of a yarn is sucked into the untwisting space by suction generated by the swirling air currents and the free end of the yarn is untwisted effectively in a state suitable for splicing by the strong actions of the swirling air currents generated by the compressed air jetted through the air jet holes arranged on different levels.

Untwisting nozzles 2 and 3 in accordance with the present invention will be described hereinafter with reference to FIGS. 10 and 11.

In the untwisting nozzle 2 (3) is provided a coaxial, cylindrical untwisting space 121, four first air jet holes 122 opening into the untwisting space 121 at positions near the inlet of the untwisting space 121, and four second air jet holes 123 opening into the untwisting space 121 at positions further away from the inlet of the untwisting space 121 than the first air jet holes 122.

The untwisting space 121 has a diameter large enough to suck the free end of a yarn. The air jet holes 122 and 123 are tangent to the circumference of the untwisting space 21 and are obliquely opened toward an outlet of the untwisting space.

The untwisting nozzle 2 (3) is provided with an annular groove 124 in the outer circumference at a position near the inlet of the untwisting space 121. When the untwisting nozzle 2 (3) is mounted on the structural member of the splicer, the annular groove 124 defines an air accumulating space between the untwisting nozzle 2 (3) and the structural member. Compressed air supplied from an external air source flows through an air passage formed in the structural member of the splicer into the air accumulating space 124 and flows through the air jet holes 122 and 123 into the untwisting space 121 in swirling air currents. The free end of the yarn is sucked in to the untwisting space 121 by suction produced by the swirling air currents. The compressed air jetted through the air jet holes 122 and 123 arranged on different levels flows in swirling air currents in the untwisting space 121 and the free end is untwisted in a state suitable for splicing by the strong untwisting action of the swirling air currents.

The numbers of the first air jet holes 122 and that of the second air jet holes 123 need not necessarily be limited to four; the greater the number of the first air jet holes 122 and that of the second air jet holes 123, the greater is the untwisting effect of the compressed air. The untwisting nozzle 2 (3) may be provided with more than two groups, for example, three or four groups in different levels, of air jet holes.

As is apparent from the foregoing description, the embodiment of the present invention has the following advantages.

The embodiment is capable of generating swirling air currents strong enough to untwist hard twist yarns satisfactorily, and the diameter of the untwisting space may be large enough to suck a thick yarn into the untwisting space. Accordingly, this embodiment of the present invention reduces the frequency of unsuccessful splicing operation and is capable of forming a joint having a satisfactory strength.

What is claimed is:

1. An untwisting nozzle for a splicer, provided with an untwisting space, at least one air jet hole for jetting compressed fluid into the untwisting space, a yarn introducing space formed in parallel to the untwisting space, an air jet hole for jetting compressed fluid into the yarn introducing space, and a slit interconnecting the untwisting space and the yarn introducing space.

2. An untwisting nozzle for a splicer, according to claim 1, wherein the untwisting space and the yarn introducing space are cylindrical, and the diameter of the former is smaller than that of the latter.

3. An untwisting nozzle for a splicer, according to claim 1, wherein gripping members capable of being moved near to the inlets of the untwisting nozzles, respectively, are further provided to prevent the propagation of twists by gripping the free ends of yarns.

4. The untwisting nozzle of claim 1, wherein the untwisting space defines a plurality of different levels and wherein the at least one air jet hole for jetting compressed fluid into the untwisting space comprises a plurality of air jet holes arranged at the different levels of the untwisting space.

5. The untwisting nozzle of claim 4, wherein the untwisting space defines a downstream side and an upstream side, wherein at least one of the plurality of air jet holes is located adjacent the downstream side and at least one of the plurality of air jet holes is located adjacent the upstream side, wherein the air jet hole located adjacent the downstream side defines a first inclination relative to the untwisting space, wherein the air jet hole located adjacent the upstream side defines a second inclination relative to the untwisting space, and wherein the first inclination is smaller than the second inclination.

* * * * *